US008059981B2

(12) United States Patent
Yamashita et al.

(10) Patent No.: US 8,059,981 B2
(45) Date of Patent: Nov. 15, 2011

(54) IMAGE FORMING APPARATUS AND CONTROL METHOD THEREFOR

(75) Inventors: Takeshi Yamashita, Osaka (JP); Yoshie Tsuchida, Osaka (JP); Makoto Matsushita, Osaka (JP)

(73) Assignee: Ricoh Company Limited, Tokyo (JP)

( * ) Notice: Subject to any disclaimer, the term of this patent is extended or adjusted under 35 U.S.C. 154(b) by 13 days.

(21) Appl. No.: 12/489,907

(22) Filed: Jun. 23, 2009

(65) Prior Publication Data

US 2009/0324270 A1 Dec. 31, 2009

(30) Foreign Application Priority Data

Jun. 26, 2008 (JP) ..... 2008-166944

(51) Int. Cl.
*G03G 15/16* (2006.01)

(52) U.S. Cl. ..... 399/66

(58) Field of Classification Search ..... 399/25, 399/27, 29, 45, 51, 55, 66, 318, 389
See application file for complete search history.

(56) References Cited

U.S. PATENT DOCUMENTS

| | | | | |
|---|---|---|---|---|
| 7,382,992 | B2 * | 6/2008 | Takeda | 399/45 |
| 2005/0280687 | A1 * | 12/2005 | Kurahashi | 347/139 |
| 2007/0201897 | A1 * | 8/2007 | Maeda et al. | 399/101 |
| 2008/0101806 | A1 * | 5/2008 | Tabata et al. | 399/45 |
| 2008/0226313 | A1 | 9/2008 | Tsuchida et al. | |
| 2009/0060540 | A1 | 3/2009 | Matsushita et al. | |
| 2009/0180791 | A1 | 7/2009 | Matsushita et al. | |

FOREIGN PATENT DOCUMENTS

| | | |
|---|---|---|
| JP | 4-251275 | 9/1992 |
| JP | 8-36329 | 2/1996 |
| JP | 3080328 | 6/2000 |
| JP | 2001-312159 | 11/2001 |
| JP | 3517621 | 1/2004 |
| JP | 3553211 | 5/2004 |
| JP | 2004-258397 | 9/2004 |
| JP | 2007-304492 | 11/2007 |

OTHER PUBLICATIONS

U.S. Appl. No. 12/437,906, filed May 8, 2009, Matsushita, et al.

* cited by examiner

*Primary Examiner* — David Porta
*Assistant Examiner* — Marcus Taningco
(74) *Attorney, Agent, or Firm* — Oblon, Spivak, McClelland, Maier & Neustadt, L.L.P.

(57) ABSTRACT

An image forming apparatus includes an image carrier, an exposure mechanism, a latent-image forming mechanism, at least one image forming mechanism including a development mechanism to develop the latent image, an intermediate transfer member disposed to contact the image carrier, a primary transfer mechanism to transfer a toner image on the image carrier and superimpose one toner image on another on the intermediate transfer member, a secondary transfer mechanism to transfer the toner image superimposed on the intermediate transfer member onto a transfer material, an asperity detector to detect an asperity profile of a surface of the transfer material to identify a concavity of the transfer material, and a toner adhesion control mechanism to increase an amount of the toner transferred to intermediate transfer member according to the concavities in the surface of the transfer material identified by an asperity detector, after a predetermined time elapses.

20 Claims, 2 Drawing Sheets

IMAGE FORMING APPARATUS AND CONTROL METHOD THEREFOR

CROSS-REFERENCE TO RELATED APPLICATION

This patent specification claims priority from Japanese Patent Application No. 2008-166944, filed in the Japan Patent Office on Jun. 26, 2008, the entire content of which is hereby incorporated by reference herein.

BACKGROUND OF THE INVENTION

1. Field of the Invention

The present invention relates to an image forming apparatus such as a copier, a printer, and a facsimile machine, and more particularly, to an electrophotographic image forming apparatus.

2. Discussion of the Background

Various types of transfer materials, such as copy sheets, are used in image forming apparatuses such as copiers, printers, facsimile machines, and the like. Depending on the purpose of image formation, a transfer material that has a rough surface, that is, a material having surface asperities, is sometimes preferred. However, when such a rough-surfaced transfer material (hereinafter "rough material") is used for printing, there is a possibility that an image formed thereon might be disturbed during the transfer process, which is a process of transferring a toner image onto the transfer material. In particular, where the surface asperities are relatively significant, gaps are created between the transfer material and the toner image that is formed on the toner image carrier that carries the toner image. Those gaps can destabilize a transfer electric field used to transfer the toner image from the image carrier, resulting in image failures such as white voids in which toner is partly absent, inconsistencies in lightness, and image density unevenness.

Several approaches described below have been proposed to prevent such image failures.

In one known image forming apparatus, an image carrier such as an intermediate transfer belt is vibrated by ultrasound to weaken adhesion between the toner and the image carrier so that the image can be transferred to the transfer material even if the electric field is unstable in the gap portions. However, in such an image forming apparatus including a vibration member, vibration noise is generated, which can annoy users. Additionally, the vibration tends to shorten the working life of other members such as the image carrier.

In another known image forming apparatus, to print high quality multicolor images, the image carrier such as an intermediate transfer belt includes an elastic layer, and its surface that carries toner is designed to have a surface micro hardness within a predetermined range to follow the asperities in the surface of the recording medium, thus reducing the gaps. However, in this known image forming apparatus, the cost of forming the elastic layer on the image carrier is relatively high. Further, this configuration cannot accommodate tiny gaps.

In another known approach, the image forming apparatus is a direct transfer type. The image forming apparatus includes an information acquisition mechanism that acquires information related to a surface structure of the transfer material, and a control mechanism that varies the degree of toner adhesion depending on the degree of surface roughness of the transfer material as indicated by the information related to the surface structure of the transfer material. Then, when a sheet reading mechanism in the information acquisition mechanism detects that the sheet has a rough surface, the control mechanism increases a transfer bias that is applied to a transfer nip during the transfer process by the control mechanism so as to increase the amount of the toner adhering to the sheet.

However, in this known image forming apparatus, although the sheet reading mechanism judges whether the surface of the sheet is rough or smooth, the judgment is made in accordance with the entire surface of transfer material, and adhesion is adjusted by varying the transfer bias.

Therefore, because this mechanism does not adjust the toner amount in accordance with localized concavities in the surface of the sheet, the overall color reproducibility has a problem, and the solid shaded and halftone areas are not balanced.

Additionally, because the toner amount is increased for the entire transfer material, the developer is consumed in excess, which is inefficient.

SUMMARY OF THE INVENTION

In view of the foregoing, one illustrative embodiment of the present invention provides an image forming apparatus that includes an image carrier, an exposure mechanism to expose the image carrier, a latent-image forming mechanism to form a latent image by exposing the image carrier, at least one image forming mechanism including a development mechanism to develop the latent image with toner, an intermediate transfer member disposed to contact the image carrier, a primary transfer mechanism to transfer a toner image on the image carrier and superimpose one toner image on another on the intermediate transfer member, a secondary transfer mechanism to transfer the toner image superimposed on the intermediate transfer member onto a transfer material, an asperity detector to detect an asperity profile of a surface of the transfer material to identify concavities in the transfer material, and a toner adhesion control mechanism to increase an amount of the toner transferred to intermediate transfer member to the concavities in the surface of the transfer material as identified by the asperity detector, after a predetermined time elapses.

Another illustrative embodiment of the present invention provides a control method for an image forming apparatus including an asperity detector and a toner adhesion control mechanism. The control method includes detecting an asperity profile of a surface of the transfer material to identify concavities of the transfer material, and adjusting an amount of toner transferred to an intermediate transfer member according to the concavities in the surface of the transfer material as identified by the asperity detector after a predetermined time elapses.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
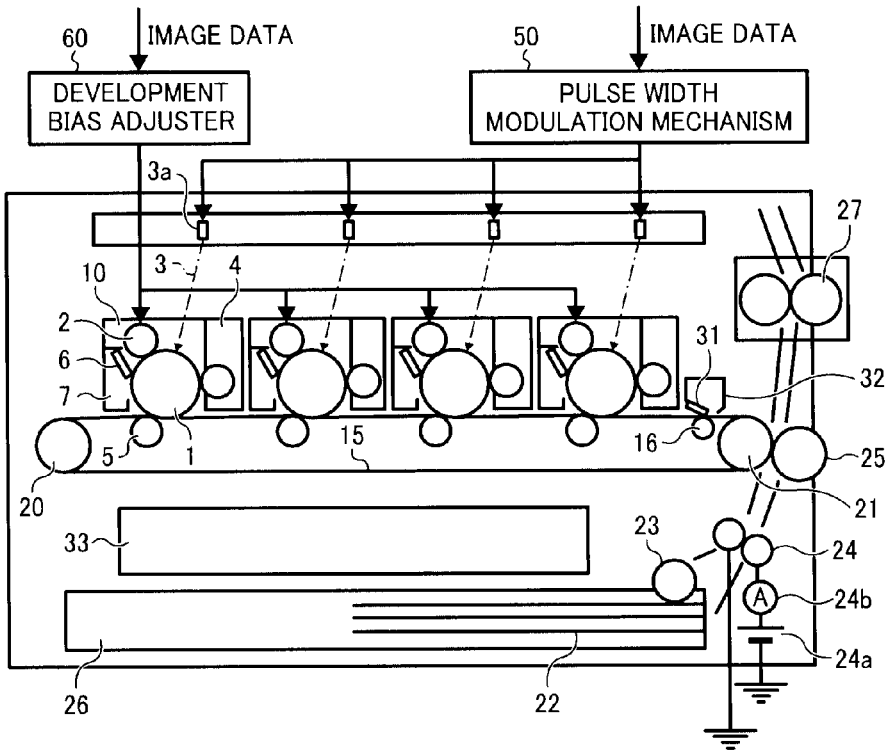
FIG. 1 is a schematic diagram illustrating a configuration of an image forming apparatus according to one illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and in particular to FIG. 1, an electrographic image forming apparatus 100 according to an embodiment of the present invention is described below.

FIG. 1 is a schematic diagram illustrating a configuration of the image forming apparatus 100 that is a tandem type multicolor printer (hereinafter also simply referred to as a printer) in the present embodiment. It is to be noted that although a printer is described below as the image forming apparatus 100 according to the present embodiment, the image forming apparatus of the present invention is not limited thereto.

Referring to FIG. 1, the printer includes four process cartridges 10, in each of which a photoreceptor drum 1, a charging device 2, and an exposure device 3 are integrated as a single unit. In each process cartridge 10, the photoreceptor drum 1 has a cylindrical shape and rotates at a circumferential velocity of 120 mm/s. The charging device 2 is pressed against a surface of the photoreceptor drums 1 and is rotated by rotation of the photoreceptor drum 1. By applying a transfer bias that is direct current (DC) or DC overlapped with alternating current (AC) to the photoreceptor drum 1 from a high-voltage power supply, not shown, an outer circumferential surface of the photoreceptor drum 1 is electrically charged uniformly.

The surface of the photoreceptor drum 1 is exposed by the exposure device 3 that is a latent-image forming mechanism, and then, a latent image is formed. In this exposure process, a laser diode (LD) 3*a* emits a modulated laser light onto the surface of the photoreceptor drum 1, forming an image thereon. Thus, by scanning the surface of the photoreceptor drum 1 with the laser light, the exposure device 3 writes a latent image on the photoreceptor drum 1 according to information of an image to be formed, that is, forms an electrostatic latent image on the photoreceptor drum 1.

In FIG. 1, reference numeral 4 indicates a one-component contact development device (hereinafter development device 4) that is a development mechanism. Due to a development bias applied from a high-voltage power source, not shown, the electrostatic latent image formed on the photoreceptor drum 1 is developed into a single-color toner image. The development device 4 contains one-component developer (toner).

In FIG. 1, the four process cartridges 10, each including the photoreceptor drum 1, the charging device 2, the exposure device 4, a photoreceptor cleaning blade 6, and a photoreceptor cleaning unit 7, are arranged in parallel. For forming multicolor (full color) images, the visible images are formed on the respective photoreceptor drums 1 in order of black, yellow, magenta, and cyan. Then, these visible images are sequentially transferred from the photoreceptor drums 1 and superimposed one on another into a multicolor image on an intermediate transfer belt 15 that contacts the photoreceptor drums 1.

The intermediate transfer belt 15 is wound around a driving roller 21 that faces a secondary transfer roller 25, a metal roller 16 that faces a belt cleaning unit 32, primary transfer rollers 5 serving as primary transfer members, and a tension roller 20. The intermediate transfer belt 15 is rotated by a driving motor, not shown, via the driving roller 21. It is to be noted that the tension roller 20 is pressed against the intermediate transfer belt 15 by a spring, not shown, so that the intermediate transfer belt 15 does not slacken.

Each primary transfer member may be a conductive blade, a conductive sponge roller, a metal roller, or the like. The metal primary transfer rollers 5 are adopted in the present embodiment. Each primary transfer roller 5 is disposed offset to the photoreceptor drums 1 in both a direction in which the intermediate transfer belt 15 rotates (hereinafter "belt transport direction") and in a vertical direction therefrom.

In a primary transfer process, a predetermined or given transfer bias voltage, for example, within a range from +500 to +1000 V is applied to each photoreceptor drum 1 (primary transfer position) via the corresponding primary transfer roller 5 by a single high-voltage power sources, not shown, for forming an electric filed via the photoreceptor drum 1, and thus, the toner image on the photoreceptor drum 1 is transferred onto the intermediate transfer belt 15.

Reference numeral 17 indicates a toner mark sensor (TM sensor) that is a specular-reflection type or dispersion-reflection type optical sensor. The TM sensor 17 measures density of the toner image and relative positions of the respective single-color images on the intermediate transfer belt 15 and adjusts the image density and the relative positions accordingly.

The belt cleaning unit 32 includes a cleaning blade 31. The belt cleaning unit 32 cleans the intermediate transfer belt 15 by scraping off residual toner with the cleaning blade 31. The residual toner is transported to a residual toner container 33 via a toner transport path, not shown.

It is to be noted that the above-described respective rollers around which the intermediate transfer belt 15 is wound are supported from both sides of the intermediate transfer belt 15 by side plates, not shown.

The intermediate transfer belt 15 is a film-like endless belt made of resin, for example, polyvinylidene fluoride (PVDF), ethylene-tetrafluoroethylene (ETFE), polyimide (PI), polycarbonate (PC), and the like in which a conductive material such as carbon black is dispersed. In the present embodiment, the intermediate transfer belt 15 is a single-layered belt formed of thermoplastic elastomer (TPE) whose modulus of elongation ranges from 1000 MPa to 2000 MPa, and carbon black is dispersed thereinto. The intermediate transfer belt 15 is 90-160 μm thick and is 230-mm wide.

A volume resistivity of the intermediate transfer belt 15 is preferably adjusted to within a range from $10^8$ Ωcm to $10^{11}$ Ωcm, and a surface resistivity thereof is preferably adjusted to within a range from to $10^8$ Ωcm to $10^{11}$ Ωcm, at a temperature of 23° C. and a relative humidity (RH) of 50%. The volume resistivity and the surface resistivity can be measured with a high resistivity meter, Hiresta UPMCP-HT450 (Mitsubishi Chemical, Ltd.), after a voltage of 500 V is applied to the intermediate transfer belt 15 for 10 seconds.

When the volume resistivity and the surface resistivity of the intermediate transfer belt 15 exceed the above-described ranges, a higher voltage is required as the primary transfer process advances downstream in the order of image formation because the intermediate transfer belt 15 is charged.

Therefore, it is difficult to use a single power source for all four primary transfer positions. This problem arises because, due to electric discharge generated in the transfer process and in a transfer-material separating process, the electrostatic charge potential of the surface of the intermediate transfer belt 15 increases and self-discharge of the intermediate transfer belt 15 becomes difficult. In order to correct this problem, a discharging mechanism for the intermediate transfer belt 15 is required.

By contrast, if the volume resistivity and the surface resistivity of the intermediate transfer belt 15 fall below the above-described ranges, although that is advantageous to remove electrical charge by self-discharge because the electrostatic charge potential of the intermediate transfer belt 15 is attenuated more quickly, electrical current flowing along the surface of the intermediate transfer belt 15 during the transfer process causes toner to scatter.

Therefore, the volume resistivity and the surface resistivity should be set to values within the range described above.

The secondary transfer roller 25, which in this embodiment is 19 mm in diameter and is 222 mm in width, includes a metal core formed of a metal such as SUS steel having an inner electrode diameter of 6 mm and an elastic body including urethane robber wrapped around the metal core. The elastic body is adjusted to have a resistance value of within a range from $10^6\Omega$ to $10^{10}\Omega$ using an electrically conductive material. More specifically, an ion conductive roller that is formed of urethane rubber into which carbon is dispersed, acrylonitrile-butadiene rubber (NBR), Hydrin, and the like or an electrically conductive roller that is formed of ethylene-propylene methylene-linkage (EPDM) is used as the secondary transfer roller 25. In the present embodiment, a urethane rubber roller that is 20 mm in diameter and has an Asker C hardness of 35 to 55° is adapted.

When the resistance value of the secondary transfer roller 25 exceeds the range described above, current cannot flow easily through the secondary transfer roller 25, and a higher voltage must be applied to the secondary transfer roller 25 so as to attain sufficient transfer performance. Thus, the cost of the power sources will increase. Additionally, in this case, because a higher voltage is applied thereto, electric discharge is generated in gaps in front and at the back of a nip of a secondary transfer portion, and consequently, toner is partly absent like white dots in a half tone image because of electric discharge. This phenomenon becomes especially pronounced under low temperature and low humidity conditions (for example, 10° C. and 15% RH).

By contrast, when the resistance value of the secondary transfer roller 25 is lower than the range described above, attaining sufficient transfer performance of both a single-color area and a multicolor (for example, three-color layer) area in a single image becomes difficult because, although the resistance value of the secondary transfer roller 25 is low, and a sufficient current for transferring the single-color image area can flow with a relatively low voltage, an optimal transfer voltage required for transferring the multicolor image area is higher than that required for the single-color image area. Therefore, when the voltage is set to a voltage optimal for the multicolor image area, the transfer current can be excessive in the single-color image area, reducing transfer efficiency.

The resistance value of the secondary transfer roller 25 is measured as follows: The secondary transfer roller 25 is set on a conductive metal plate, and a load of 4.9 N is applied to each end portion of the metal core (both side 9.8 N). Then, the resistance value is calculated based on an electrical current that flows when a voltage of 1 kV is applied to between the core metal and the conductive metal plate under these conditions.

The printer further includes a feed roller 23 that feeds a transfer material 22 as a recording medium, a pair of registration rollers 24, a sheet bank 26, and a fixing device 27. The transfer material 22 is fed by the feed roller 23 and the pair of transport rollers 24 to the secondary transfer position, timed to coincide with the arrival of a leading edge of the multicolor image on the intermediate transfer belt 15, and then the multicolor image on the intermediate transfer belt 15 is transferred onto the transfer material 22 by the secondary transfer roller 25. Although a sheet feed route in the present embodiment is a vertical path, but the sheet feed route is not limited thereto.

After the transfer material 22 is separated from the intermediate transfer belt 15 by curvature of the driving roller 21, the transfer material 22 on which the multicolor toner image is transferred is transported to the fixing device 27. Then, the multicolor toner image is fixed on the transfer material 22 by the fixing device 27. Thereafter, the transfer material 22 is discharged.

Figure 2:
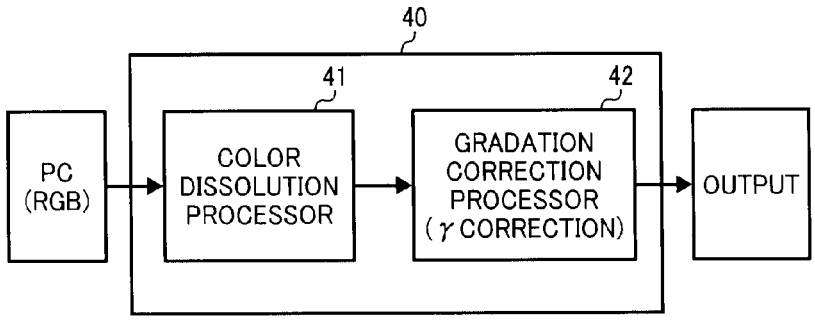
FIG. 2 is a block diagram illustrating a control mechanism of the image forming apparatus a control mechanism including an image processor.

FIG. 2 is a block diagram illustrating a control mechanism of the image forming apparatus 100 shown in FIG. 1. The control mechanism includes an image processor 40.

Input data from an image input portion such as PC is RGB image data (red-green-blue color data). The data is dissolved from RGB color spaces to respective Y, M, C, and K color spaces by a color dissolution processor 41 in the image processor 40. Then, in order to attain a gradation preset by a gradation correction processor 42, serving as an image data correction mechanism that also serves as a toner adhesion control mechanism, γ (gamma) correction is performed, and the amount of the toner that forms a toner image on the transfer material 22 is adjusted. Color dissolution and γ correction can be performed using known techniques, and thus descriptions thereof are omitted herein.

Next, an asperity detection and identification mechanism or asperity detector according to the present embodiment that detects surface asperities of the transfer material 22 is described below.

First Embodiment of an Asperity Detector

Referring to FIG. 1, a configuration in which the pair of metal registration rollers 24 is provided with an asperity profile reading device is described below.

The transfer material 22 is transported from the sheet bank 26 to the secondary transfer position via the pair of registration rollers 24. In the present embodiment, each metal registration roller 24 is formed of SUS 301 and is 12 mm in diameter and 30 mm in length in a direction of an axis of the metal roller. A power source 24*a* that applies a voltage of 1.0 kV to the registration rollers 24 and an ammeter or current detection member 24*b* that detects strength of the current that flows through the registration rollers 24 together form the asperity profile determination device.

In the present embodiment, the asperity profile of the transfer material 22 is detected indirectly by the current detection member 24*b* as the strength of the current that flows through the registration rollers 24. Thus, in the present embodiment, a load of 1 Kilo Newton (kN) is applied across the entire registration roller 24. When the transfer material 22 has a rough surface, that is, large asperities, such a rough material includes a relatively large amount of air between fibers, and therefore, a deformation amount, that is, a degree of compression when compressed, is relatively large. (It is to be noted here that the transfer material includes not only paper but also similar materials.) By contrast, when the transfer material has relatively small surface asperities, its deformation amount is smaller even when the same amount of mechanical pressure is applied thereto. The amount of extent of deformation amount of the transfer material when compressed is reflected in the strength of the current that flows through the transfer material 22 at that time, and thus the degree of roughness or surface asperities of the transfer material can be indirectly detected from the current. In other words, in the present embodiment, the surface asperities of the transfer material can be detected and identified by indirectly detecting the deformation amount of the transfer material based on the strength of the current.

Second Embodiment of the Asperity Detector

An asperity detector according to a different configuration is described below as a second embodiment.

Figure 3:
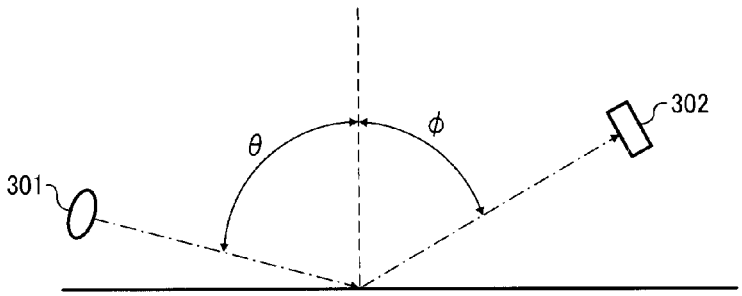
FIG. 3 illustrates a configuration of an asperity detector that is different from an asperity detector shown in FIG. 1.

FIG. 3 illustrates a configuration of the asperity detector that is different from that in the first embodiment. Referring to FIG. 3, in the present embodiment, a light-emitting mechanism 301 and a light-receiving mechanism 302 together form the asperity detector instead of the power source 24*a* and the current detection member 24*b* shown in FIG. 1. When the light-emitting mechanism 301 emits light, the light-receiving mechanism 302 receives the light reflected from the surface of the transfer material that is transported vertically in FIG. 1. The amount of the light thus received is measured for detection of the asperity profile of the transfer material, that is, the asperity information is detected by the light-receiving mechanism 302. The light-emitting mechanism 301 and the light-receiving mechanism 302 are located on the sheet feed route (sheet transport path) between the feed roller 23 and the secondary transfer roller 25 facing the surface of the transfer material onto which the toner image is transferred (image surface).

As for the light-emitting mechanism 301, a laser displacement gauge (for example, LJ-G080 manufactured by KEYENCE) can be used. Additionally, multiple laser displacement gauges can be disposed corresponding to the width of the transfer material. As shown in FIG. 3, the light-emitting mechanism 301 is set at an incident angle of 75° degrees to the transfer material. The light-receiving mechanism 302 is disposed to receive the reflection light whose departure angle is 60° degrees to transfer material. In the present embodiment, the light-receiving mechanism 302 can be a photodiode.

Generally, when the degree of the brilliance of the transfer material is so low that the amount of the specular-reflected light received by the light-receiving mechanism 302 is lower than 10% of the amount of the light emitted from the light-emitting mechanism 301, identification of the surface asperity based on the received amount of the specular-reflected light is difficult. Thus, in this case, the asperity detector identifies the surface asperity based on the received amount of dispersion-reflection light instead of the received amount of the specular-reflected light.

In the present embodiment, the amount of the received reflection light, serving as an indicator of the surface asperities of the transfer material, is detected corresponding to a receiving position, that is, displacement of the detection condition on the same transfer material. More specifically, when the light-emitting mechanism 301 emits light, the light-receiving mechanism 302 receives the light secular-reflected on the surface of the transfer material. The amount of the light thus received is measured to detect the asperity profile of the transfer material.

Further, when the laser displacement gauge also serves as a leading edge position detector that detects the leading edge position of the transfer material, because the position of the transfer material can be detected relatively accurately, images can be transferred onto transfer materials without positional displacement even if the transfer materials have concavities.

(Adjustment of Toner Amount by the Toner Adhesion Control)

Adjustment of toner amount by the toner adhesion control mechanism is described below. The toner is degraded over time, that is, an additive in an outer layer of toner particles is peeled or toner particles are divided, and then wax included therein is exuded to the outer surfaces of the toner particles. Consequently, the adherence force of the toner to the intermediate transfer belt 15 is increased, and accordingly the toner is less likely to move from the intermediate transfer belt 15 to the transfer material by the electrostatic force.

Therefore, in the present embodiment, the toner adhesion control mechanism adjusts the amount of the toner to be adhered (hereinafter "toner adhesion"), that is, according to the amount of time that the process cartridge 10 shown in FIG. 1 has been in operation. More precisely, the longer the process cartridge 10 has been in operation, the greater the amount of toner to be adhered. This adjustment is performed after the asperity profile is detected by the above-described asperity detector. In the present embodiment, in the controlling process, a cumulative travel distance of the process cartridge 10 is recorded on an identification (ID) chip and read from the ID chip. Alternatively, the travel distance is calculated by the number of rotations of a motor that drives the process cartridge 10. Then, the amount of the toner adhesion is adjusted in accordance with a predetermined correlation table between the travel distance and a rate of increase of the amount of toner adhesion. In this adjustment, only the amount of the toner that is initially transferred to the intermediate transfer member, such as, the intermediate transfer belt 15, is adjusted.

"The toner that is initially transferred to the intermediate transfer member" is described below. The color that is an object of the toner amount adjustment depends on the image pattern, and therefore, for example, when the image pattern to be formed is a green (G) filled-in image, the initially-transferred color is yellow (Y). In other words, as described above, because the photoreceptor drums 1 are arranged in parallel in order of black (K), yellow (Y), magenta (M) and cyan(C) from the side of second transfer unit 25 in FIG. 1, when the green image is formed, "the toner that is initially transferred to the intermediate transfer member" is the yellow toner, which is the object of controlling. The color of "the toner that is initially transferred to the transfer member" can differ according to the color of the image to be formed. The exact control method of the toner amount, which can be identical to that according to the asperity profile described above, is described below.

Figure 4:
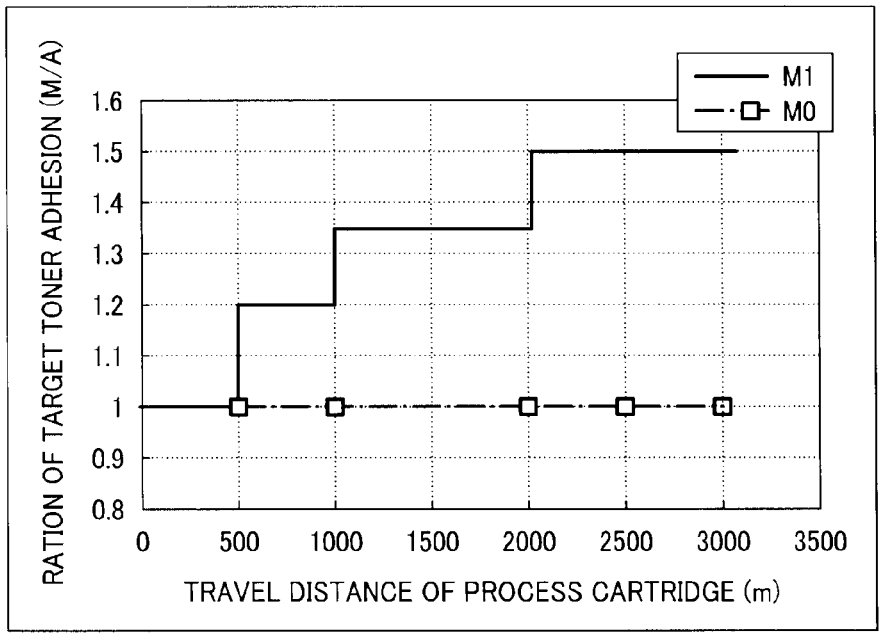
FIG. 4 is a graph of the correlation between travel distance of a process cartridge and rate of increase in toner amount.

FIG. 4 is a graph of the correlation between the travel distance of the process cartridge 10 and the rate of increase of the toner adhesion. In FIG. 4, a horizontal axis shows the travel distance of the process cartridge 10 in meters, and a vertical axis shows a ratio of a target toner amount M1 (mass per unit area or M/A) when the toner amount adjustment is controlled to a target toner amount M0 when the toner amount adjustment is not performed (hereinafter "standard target toner amount M0"). In this graph, the solid line shows target toner amount M1 in the toner amount adjustment in the present embodiment, and the dashed line shows the standard target toner amount M0. When the travel distance of the process cartridge 10 is less than 500 m, the target toner amount is not changed according to the travel distance. By contrast, when the travel distance is 500 mm or more, the target toner amount M1 is slightly increased according to the travel distance from the standard target toner amount M0.

As described below, the amount of "the toner that is initially transferred to the intermediate transfer member" is increased as the travel distance of the process cartridge 10 increases.

(Mechanism for Adjusting the Toner Amount)

Three configurations of the exact mechanism for adjusting the toner amount are described in detail below.

(Configuration 1)

In the first configuration, the toner adhesion control mechanism is the gradation correction processor 42 shown in FIG. 2. The gradation correction processor 42 adjusts the amount of the toner adhering to the latent image that is formed by the laser diode 3*a*, serving as a latent-image forming mechanism, by performing γ correction based on the result generated by the asperity detector. Consequently, the amount of the toner forming toner images can be adjusted by using the image data correction mechanism that controls the amount of the toner forming the toner image on the transfer material. Therefore, based on the identified surface asperity, the amount of the toner forming the toner image on the transfer material can be adjusted using a relatively simple configuration.

(Configuration 2)

The laser diode element 3*a* forms a latent image with multiple dots by repeatedly emitting pulse-type writing light based on the image data. In the second example, the pulse width modulation mechanism 50 adjusts the amount of the toner adhering to the latent image that is formed by the laser diode 3*a* through pulse width modulation (PWM) of the writing light based on the result generated by the asperity detector. Consequently, the amount of the toner forming the toner image can be adjusted by using the pulse width modulation mechanism that controls the amount of the toner forming the toner image on the transfer material. Therefore, based on the identified surface asperity, the amount of the toner forming the toner image onto the transfer material can be adjusted by a relatively simple configuration.

(Configuration 3)

The development unit 4 serving as a development mechanism that applies a development bias to the development roller 2, forms the electric field between the development roller 2 and the latent image, and causes the toner that is held on the development roller 2 to adhere to the latent image. In the third configuration, the toner adhesion control mechanism is a development bias adjuster 60. The development bias adjuster adjusts the amount of the toner held on the development roller 2 by adjusting developing bias based on the result generated by the asperity detector. Consequently, the amount of the toner forming the toner images can be adjusted by adjusting the developing bias.

Figure 5:
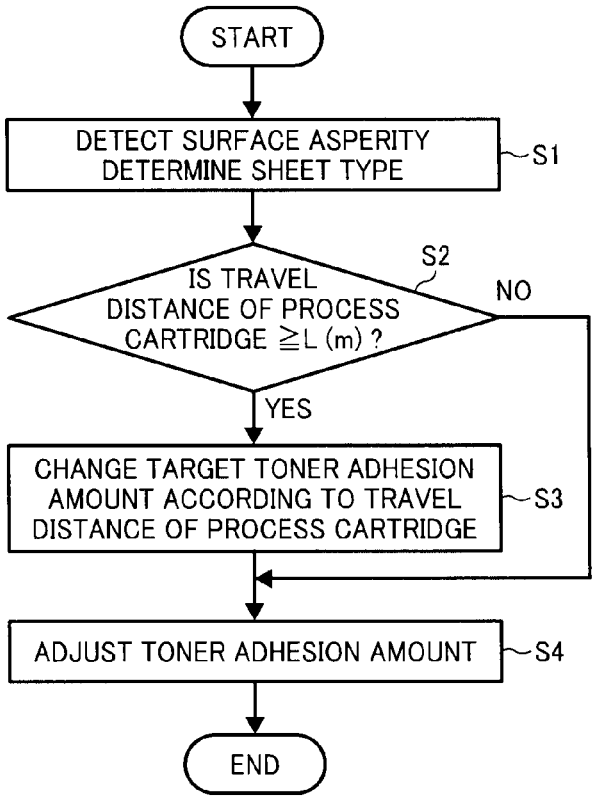
FIG. 5 is a flowchart illustrating steps in a process of toner amount adjustment according to one illustrative embodiment.

FIG. 5 is a flowchart illustrating steps in a process of toner amount adjustment, from the detection and the identification of the asperity profile to the adjustment of the toner amount in accordance with the travel distance of the process cartridge 10.

At S1, the type of the transfer material is determined, in other words, whether or not the surface of the sheet is rough is determined by the asperity detector. At S2, whether or not the travel distance of the process cartridge is L m or greater is detected. When the travel distance is L m or greater (YES at S2), the target toner amount is corrected in accordance with the travel distance at S3. When the travel distance is shorter than L m (NO at S2), the process proceeds to S4. At S4, the amount of the toner adhesion is adjusted.

(Effects of the Toner Amount Adjustment)

Effects of the toner amount adjustment are described below.

In order to evaluate the effectiveness of toner amount adjustment of the present embodiment, the present embodiment was compared with comparative examples 1, 2, and 3. The concrete differences between them are shown in table 1 and described below.

TABLE 1

| | | Correction in accordance with travel distance of process cartridge | |
|---|---|---|---|
| | | Yes | No |
| Adjustment of toner amount | A toner layer initially transferred to intermediate transfer member | Present embodiment | Comparative example 3 |
| | Entire toner layers | Comparative example 2 | — |
| | No | — | Comparative example 1 |

The condition of the present embodiment of the present invention includes both the adjustment of the amount of the toner that is initially transferred to the intermediate transfer member in accordance with the asperity profile of the transfer material and the adjustment of the amount of the toner in accordance with the travel distance of the process cartridge.

By contrast, the condition of the comparative example 1 includes neither of the adjustments of the toner amount described above. In the comparative example 2, the amount of the toner is adjusted in accordance with the travel distance of the process cartridge similarly to the present embodiment. Additionally, regarding the adjustment according to the asperity profile of the transfer material, the amount of not only the toner initially transferred to the intermediate transfer member but also all four toners, that is, all the toner layers superimposed one on another on the intermediate transfer member. The condition of the comparative example 3 does not include the adjustment of the amount of the toner in accordance with the travel distance of the process cartridge.

The evaluation conditions of the present embodiment are described below.

As for the transfer material, an A4-sized sheet of wavy Japanese paper, Sazanami, manufactured by Ricoh was used. In order to detect and identify the surface asperities, the method to measure the strength of the electrical current flowing through the pair of registration rollers 24 when the bias is applied to them was used. A process cartridge whose travel distance was 1500 m was used. As for the method to control the amount of the toner adhesion, the increase ratio of the target toner amount M1 (M/A) from the standard target toner amount M0 was 1.35, and then, based on the asperity profile described above, the amount of the toner adhesion M1 (M/A) was adjusted by the γ correction.

Table 2 shows evaluation results of the image density unevenness and the color contrast of a green filled-in image.

Regarding the image density unevenness, the result was classified as "excellent", "good", "slightly insufficient", or "bad" by visual inspection. The result of the image density shows that the present embodiment is excellent, the comparative example 1 is bad, the comparative example 2 is excellent, and the comparative example 3 is good.

The color contrast was evaluated based on ΔE (color difference). Namely, regarding the color contrast, differences in color (color measurement value) between a color a green filled-in image transferred onto a smooth transfer sheet and that transferred onto the wavy Japanese paper were calculated as color difference ΔE in each of the present embodiment and the comparative examples 1 through 3. The range of the color difference ΔE is classified as "Excellent" when ΔE is within the range from 0 to 1.5, "good" when ΔE is within the range from 1.5 to 3.0, "slightly insufficient" when ΔE is within the range from 3.0 to 4.5, and "bad" when ΔE is within the range 4.5 or more.

As the results of color contrast evaluation, ΔE in the present embodiment was 0.3 and classified as excellent, ΔE in comparative example 1 was 5.3 and classified as bad, ΔE in comparative example 2 was 3.6 and classified as slightly insufficient, and ΔE in comparative example 3 was 2.9 and classified as good.

TABLE 2

| | Image density evenness | Color contrast |
|---|---|---|
| Present embodiment | Excellent | Excellent |
| Comparative example 1 | Bad | Bad |
| Comparative example 2 | Excellent | Slightly insufficient |
| Comparative example 3 | Good | Good |

With reference to Table 2, in the configuration of the present embodiment, both the image density evenness and the color contrast were excellent. In the comparative example 1, the toner adhesion was not adjusted and as a result, the image density evenness and the color contrast were bad. In the comparative example 2, the toner adhesion was adjusted in accordance with the asperity profile. The amount of not only yellow but also both of the cyan and the yellow toners forming the green color were increased, and as a result, the color contrast was bad even though the image density evenness was excellent. In the comparative example 3, although the amount of only "the toner that was initially transferred to the intermediate transfer member" was adjusted according to the surface asperities of the transfer material, the toner adhesion was not adjusted in accordance with the travel distance of the process cartridge. As a result, although the image density evenness and the color contrast were good in the comparative example 3, the evaluation results of the present embodiment were better than those of the comparative example 3.

As described above, the image forming apparatus according to the above-described various illustrative embodiments of the present invention includes an image carrier, a latent-image forming mechanism to form a latent image by exposing the image carrier, at least one image forming mechanism that includes the development mechanism, a primary transfer mechanism to transfer a toner image on the image carrier and superimpose one toner image on another onto the intermediate transfer member, a secondary transfer mechanism to transfer the toner image superimposed on the intermediate transfer member onto a transfer material. Further, the image forming apparatus includes an asperity detector to detect an asperity profile of surface of the transfer material to identify concavities in the surface material by the asperity profile, and a toner adhesion control mechanism to adjust an amount of the toner transferred to the intermediate transfer member according to the concavities in the surface of the transfer material identified by the asperity identification mechanism, after a predetermined time elapses. Therefore, the image forming apparatus can equalize the amount of the toner transferred onto the transfer material.

What is claimed is:

1. An image forming apparatus comprising:

an image carrier;

an exposure mechanism to expose the image carrier;

a latent-image forming mechanism to form a latent image by exposing the image carrier;

at least one image forming mechanism including a development mechanism to develop the latent image with toner;

an intermediate transfer member disposed to contact the image carrier;

a primary transfer mechanism to transfer a toner image on the image carrier and superimpose one toner image on another on the intermediate transfer member;

a secondary transfer mechanism to transfer the toner image superimposed on the intermediate transfer member onto a transfer material;

an asperity detector to detect an asperity profile of a surface of the transfer material to identify concavities in the surface of the transfer material; and a toner adhesion control mechanism to increase a ratio of an amount of toner per unit area transferred to the intermediate transfer member according to the concavities in the surface of the transfer material as identified by the asperity detector after a predetermined time elapses in accordance with an amount of time that the image carrier and the development mechanism have been in operation.

2. The image forming apparatus according to the claim 1, wherein the asperity detector comprises a light emitting mechanism to emit a light and a light receiving mechanism to receive light reflected from the surface of the transfer material; and wherein the asperity detector detects and identifies an amount of light received as the asperity profile of the transfer material.

3. The image forming apparatus according to claim 2, wherein the light emitting mechanism and the light receiving mechanism detect a leading edge of the transfer material.

4. The image forming apparatus according to claim 1, wherein the asperity detector detects a strength of a current that flows through a sandwiching member that sandwiches the transfer material when a voltage is applied to the sandwiching member.

5. The image forming apparatus according to claim 4, wherein the asperity detector is provided on a pair of rollers that transport the transfer material to a contact position between the secondary transfer mechanism and the intermediate transfer member.

6. The image forming apparatus according to claim 1, further comprising:

a process cartridge detachably attachable to a body of the image forming apparatus, with at least the development mechanism and the image carrier included in the process cartridge.

7. The image forming apparatus according to claim 6, wherein the amount of time the image carrier and the development mechanism have been in operation is an elapsed time calculated based on a readout from an identification chip (ID) attached to the process cartridge that records a travel distance of the process cartridge, and the ratio to the amount of the toner adhesion per unit area is increased as the elapsed time increases.

8. The image forming apparatus according to claim 6, wherein the amount of time the image carrier and the development mechanism have been in operation is an elapsed time calculated based on a cumulative number of rotations of a motor that drives the process cartridge, and the ratio of the amount of the toner adhesion per unit area is increased as the elapsed time increases.

9. The image forming apparatus according to claim 6, wherein an amount of toner forming the toner image on the transfer material is controlled by adjusting an amount of the toner adhering to the latent image through γ correction of image data based on a result generated by the asperity detector and a travel distance of the process cartridge.

10. The image forming apparatus according to claim 6, wherein an amount of toner forming the toner image on the transfer material is controlled by adjusting an amount of the toner adhering to the latent image through pulse width modulation (PWM) of a writing light emitted from the latent-image forming mechanism based on a result generated by the asperity detector and a travel distance of the process cartridge.

11. The image forming apparatus according to claim 6, wherein an amount of toner forming the toner image on the transfer material is controlled by adjusting an amount of the toner adhering to the latent image by adjusting a development bias in the development mechanism based on a result generated by the asperity detector and a travel distance of the process cartridge.

12. A control method for the image forming apparatus according to claim 1, the control method comprising:

detecting the asperity profile of the surface of the transfer material to identify concavities of the transfer material; and adjusting the ratio of the amount of the toner per unit area transferred to the intermediate transfer member according to the concavities of the surface of the transfer material as identified by the asperity detector after the predetermined time elapses.

13. The control method according to claim 12, wherein the asperity detector comprises a light-emitting mechanism to emit a light and a light-receiving mechanism to receive light reflected from the surface of the transfer material, the control method further comprising detecting an amount of light received by the light-receiving mechanism as the asperity profile.

14. The control method according to claim 12, further comprising:

applying a voltage to a sandwiching member that sandwiches the transfer material and detecting a strength of a current sent through the sandwiching member as the asperity profile.

15. The control method according to claim 12, wherein the image forming apparatus further comprises a process cartridge detachably attached to the image forming apparatus body that includes at least the development mechanism and the image carrier, the control method further comprising:

reading a travel distance of the process cartridge using an identification (ID) chip attached to the process cartridge;

calculating an elapsed time based on the travel distance read by the ID chip; and increasing the ratio of the amount of the toner adhesion per unit area as the elapsed time increases.

16. The control method according to claim 12, wherein the image forming apparatus further comprises a process cartridge detachably attached to the image forming apparatus body that includes at least the development mechanism and the image carrier, the control method further comprising:

calculating an elapsed time based on a cumulative number of rotations of a motor that drives the process cartridge; and increasing the ratio of the amount of the toner adhesion per unit area as the elapsed time increases.

17. The control method according to claim 12, wherein the image forming apparatus further comprises a process cartridge detachably attached to the image forming apparatus body that includes at least the development mechanism and the image carrier, the control method further comprising:

performing γ correction of image data based on a result generated by the asperity detector and a travel distance of the process cartridge; and adjusting an amount of the toner adhering to the latent image based on the γ correction to control an amount of toner forming the toner image on the transfer material.

18. The control method according to claim 12, wherein the image forming apparatus further comprises a process cartridge detachably attached to the image forming apparatus body that includes at least the development mechanism and the image carrier, the control method further comprising:

modulating a pulse width of a writing light emitted from the latent-image forming mechanism based on a result generated by the asperity detector and a travel distance of the process cartridge; and adjusting an amount of the toner adhering to the latent image through pulse width modulation (PWM) to control an amount of toner forming the toner image on the transfer material.

19. The control method according to claim 12, wherein the image forming apparatus further comprises a process cartridge detachably attached to the image forming apparatus body that includes at least the development mechanism and the image carrier, the control method further comprising:

adjusting a development bias in the development mechanism based on a result generated by the asperity detector and a travel distance of the process cartridge; and adjusting an amount of the toner adhering to the latent image based on the development bias adjustment to control an amount of toner forming the toner image onto the transfer material.

20. The image forming apparatus according to claim 1, wherein the toner adhesion control mechanism increases the ratio of the amount of toner per unit area transferred to the intermediate transfer member based on a plurality of predetermined ratios corresponding to a plurality of predetermined amounts of distance that the image carrier and the development mechanism have been in operation.

* * * * *